US006213782B1

(12) United States Patent
Derstine

(10) Patent No.: US 6,213,782 B1
(45) Date of Patent: Apr. 10, 2001

(54) INPUT/OUTPUT CONNECTOR WITH HINGED MEMBER

(75) Inventor: Michael Paul Derstine, Winston-Salem, NC (US)

(73) Assignee: The Whitaker Corporation, Wilmington, DE (US)

( * ) Notice: Subject to any disclaimer, the term of this patent is extended or adjusted under 35 U.S.C. 154(b) by 0 days.

(21) Appl. No.: 09/456,267

(22) Filed: Dec. 7, 1999

Related U.S. Application Data

(60) Provisional application No. 60/112,180, filed on Dec. 14, 1998.

(51) Int. Cl.[7] ..... H01R 39/00
(52) U.S. Cl. ..... 439/31; 439/640
(58) Field of Search ..... 439/31, 131, 640, 439/165, 638, 676

(56) References Cited

U.S. PATENT DOCUMENTS

| | | | | |
|---|---|---|---|---|
| 5,183,404 | | 2/1993 | Aldous et al. | 439/55 |
| 5,330,360 | | 7/1994 | Marsh et al. | 439/76 |
| 5,411,405 | | 5/1995 | McDaniels et al. | 439/131 |
| 5,562,463 | | 10/1996 | Tan | 439/76.1 |
| 5,634,802 | | 6/1997 | Kerklaan | 439/131 |
| 5,637,018 | | 6/1997 | Gargiulo | 439/640 |
| 5,658,152 | * | 8/1997 | Selker | 439/31 |
| 5,681,176 | * | 10/1997 | Ibaraki et al. | 439/31 |
| 5,692,921 | * | 12/1997 | Jennings | 439/31 |
| 5,995,373 | * | 11/1999 | Nagai | 439/31 |
| 6,074,253 | * | 6/2000 | Brinchmann-Hansen | 439/640 |

* cited by examiner

*Primary Examiner*—Paula Bradley
*Assistant Examiner*—Tho D. Ta

(57) ABSTRACT

An electrical interconnection device comprises a first connector member having a first mating end and a second connector member having a second mating end. The first connector member may be a printed circuit card I/O connector, and the second connector member may be a telecommunications adapter connector such as a modular jack. The first and second connector members are pivotally linked to permit relative angular movement therebetween.

6 Claims, 7 Drawing Sheets

INPUT/OUTPUT CONNECTOR WITH HINGED MEMBER

CROSS-REFERENCE TO RELATED APPLICATIONS

This application claims the benefit of U.S. Provisional Application Ser. No. 60/112,180 filed Dec. 14, 1998.

FIELD OF THE INVENTION

The invention relates to an electrical interconnection device which provides a link between a cable and a computer input/output port.

BACKGROUND OF THE INVENTION

Printed circuit (PC) cards are known for use with a computer to enhance the operational capabilities of the computer. Many of these PC cards have an input/output (I/O) header that mates with an I/O connector at one end of a cable assembly to permit the PC card and the computer to communicate with external resources. When the I/O connector of the cable assembly is attached to the PC card, the connector protrudes from the PC card beyond the case of the computer. This leads to the problem that the I/O connector is prone to breakage, especially when the computer is tilted by having one end raised such that a load is imposed on the I/O connector at the other end.

Another problem relates to the cable assembly itself. The other end of the cable assembly has a connector of a type which can vary depending on the nature of the PC card and the application for which it is being used. For example, a connection with a local area network (LAN), a facsimile machine or telephone line requires a telecommunications connector which is typically configured as a modular jack that can mate with a standard RJ-series modular plug. The cable assembly is a relatively expensive link between the I/O connector at one end and the telecommunications connector at the other end.

There is a need for an interconnection device which provides an interface between a computer PC card and communications equipment, which is relatively inexpensive and is not prone to breakage.

SUMMARY OF THE INVENTION

The invention is an electrical interconnection device comprising a first connector member having a first mating end and a second connector member having a second mating end, wherein the first connector member and the second connector member are pivotally linked to permit relative angular movement between the first and the second electrical members.

One of the connector members has journals which are pivotably received in bores in the other of the connector members. The connector members are pivotable on a pivot axis which extends through the journals and the bores.

The first connector member may be a printed circuit card I/O connector, and the second connector member may be a telecommunications adapter connector such as a modular jack.

In one embodiment the adapter connector has a receptacle which is open in a direction that is parallel to a longitudinal axis of the I/O connector.

In another embodiment the adapter connector has a receptacle which is open in a direction that is perpendicular to the longitudinal axis of the I/O connector.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
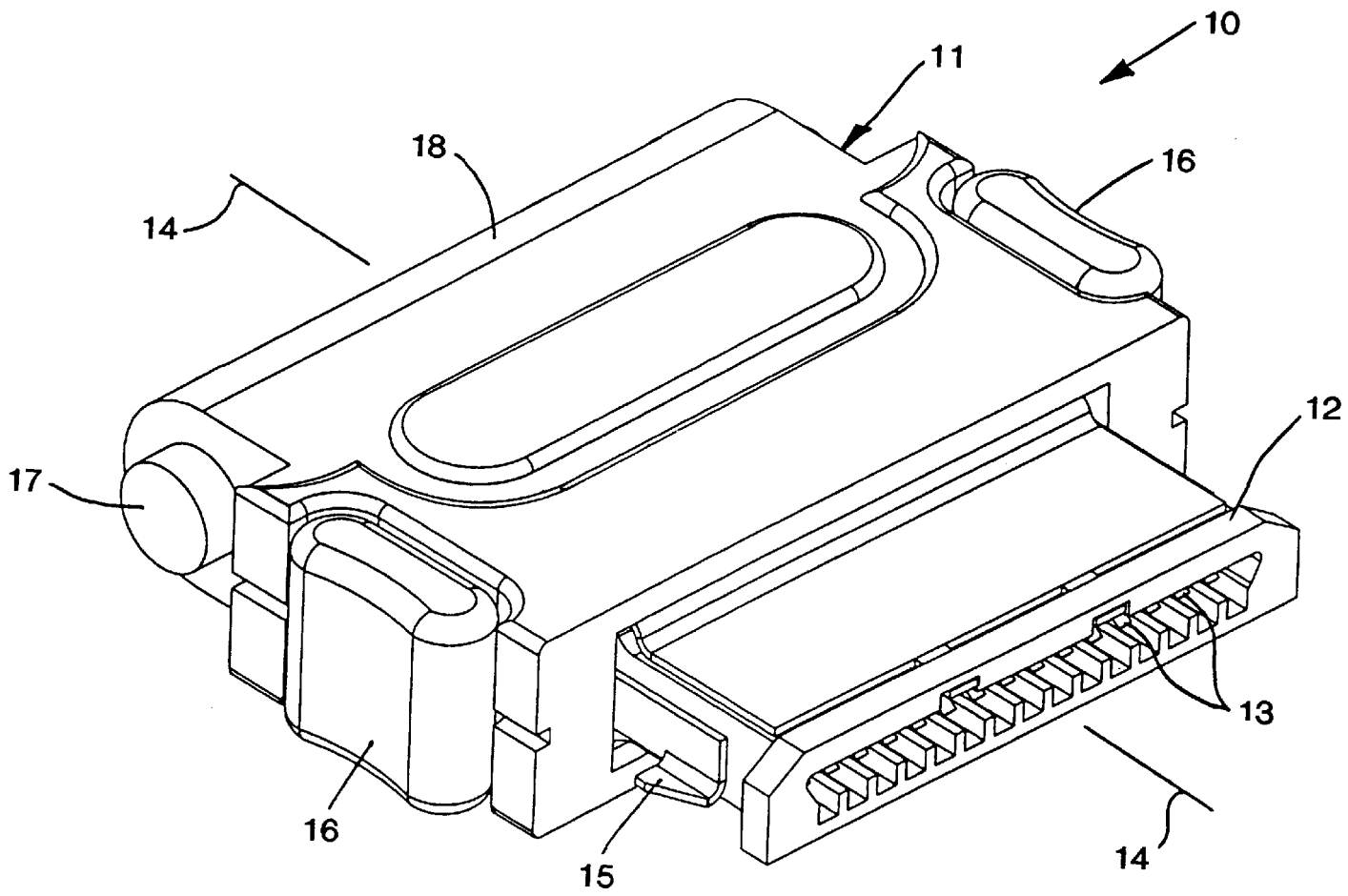
FIG. 1 is a front isometric view of an I/O connector which is used in an interconnection device according to the invention.
Figure 2:
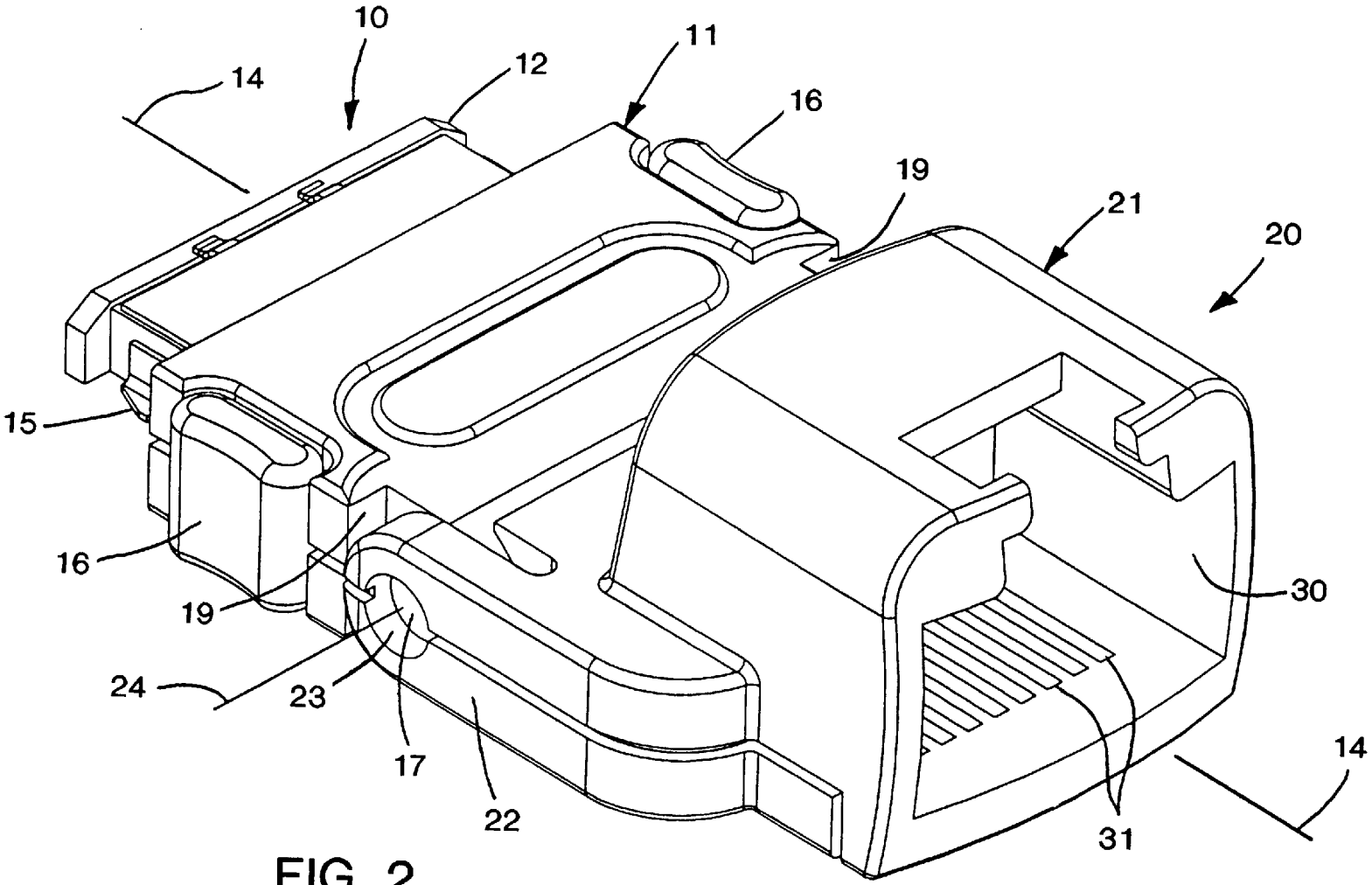
FIG. 2 is a rear isometric view of the interconnection device including the I/O connector and a horizontal loading adapter.
Figure 3:
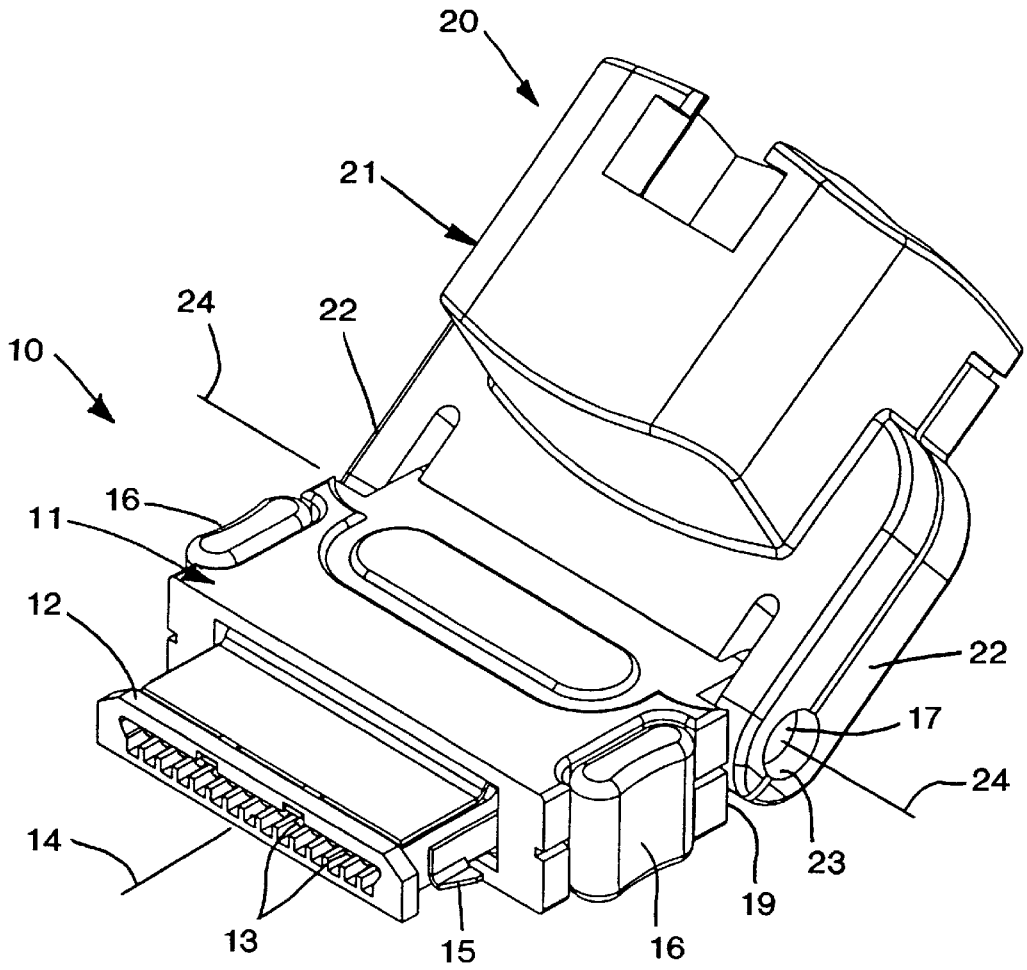
FIG. 3 is a front isometric view of the interconnection device showing the horizontal loading adapter angularly displaced with respect to the I/O connector.

There is shown in FIGS. 1–3 an interconnection device comprising a first connector member 10 and a second connector member 20. The first connector member is an input/output (I/O) connector which includes a housing 11 having a first mating end 12 that is configured according to standards issued by the Personal Computer Memory Card International Association (PCMCIA) for matability with a standard I/O header of a PC card (not shown). Such an I/O header and PC card are shown in U.S. Pat. No. 5,330,360 which is incorporated by reference as if set forth fully herein.

The I/O connector 10 holds contacts 13 which are secured in the housing 11. These contacts may be aligned in a single horizontal row as shown, or in two parallel horizontal rows. The I/O connector defines a longitudinal axis 14 which extends in the directions of mating and unmating of the I/O connector and is perpendicular to the row of contacts 13. The I/O connector has latches 15 which cooperate with structure on the PC card I/O header to secure the I/O connector to the header. A pair of actuators 16 on opposite sides of the housing 11 are squeezable in a direction transverse to the axis 14 to release the latches 15 and permit withdrawal of the I/O connector from the header. The housing has a pair of pivot pins or journals 17 at a rear section thereof.

The second connector member 20 may be configured as an adapter for mating with a connector of a different type than the PC card I/O connector. The second connector member is shown in FIGS. 2 and 3 to be modular jack adapter that can mate with a standard RJ-series modular plug. The second connector member includes a housing 21 which is pivotally attached to the housing 11 of the first connector member 10. The housing 21 includes a pair of arms 22 which have bores 23 that receive the journals 17 with a small diametral clearance to permit pivoting of the arms on an axis 24 extending through the journals.

The adapter which is shown in the embodiment of FIGS. 2 and 3 is termed a horizontal loading adapter. This adapter has a second mating end including a receptacle 30 and contacts 31 that are configured to mate with a modular plug. The receptacle 30 is open to the rear of the adapter for receiving the modular plug in a direction which is parallel to the axis 14 of the I/O connector. The adapter is pivotable on the axis 24 through an angle which extends both above and below the axis 14. The pivoting angle may be limited by stop surfaces 19 on the I/O connector which are engaged by surfaces of the arms 22.

Figure 4:
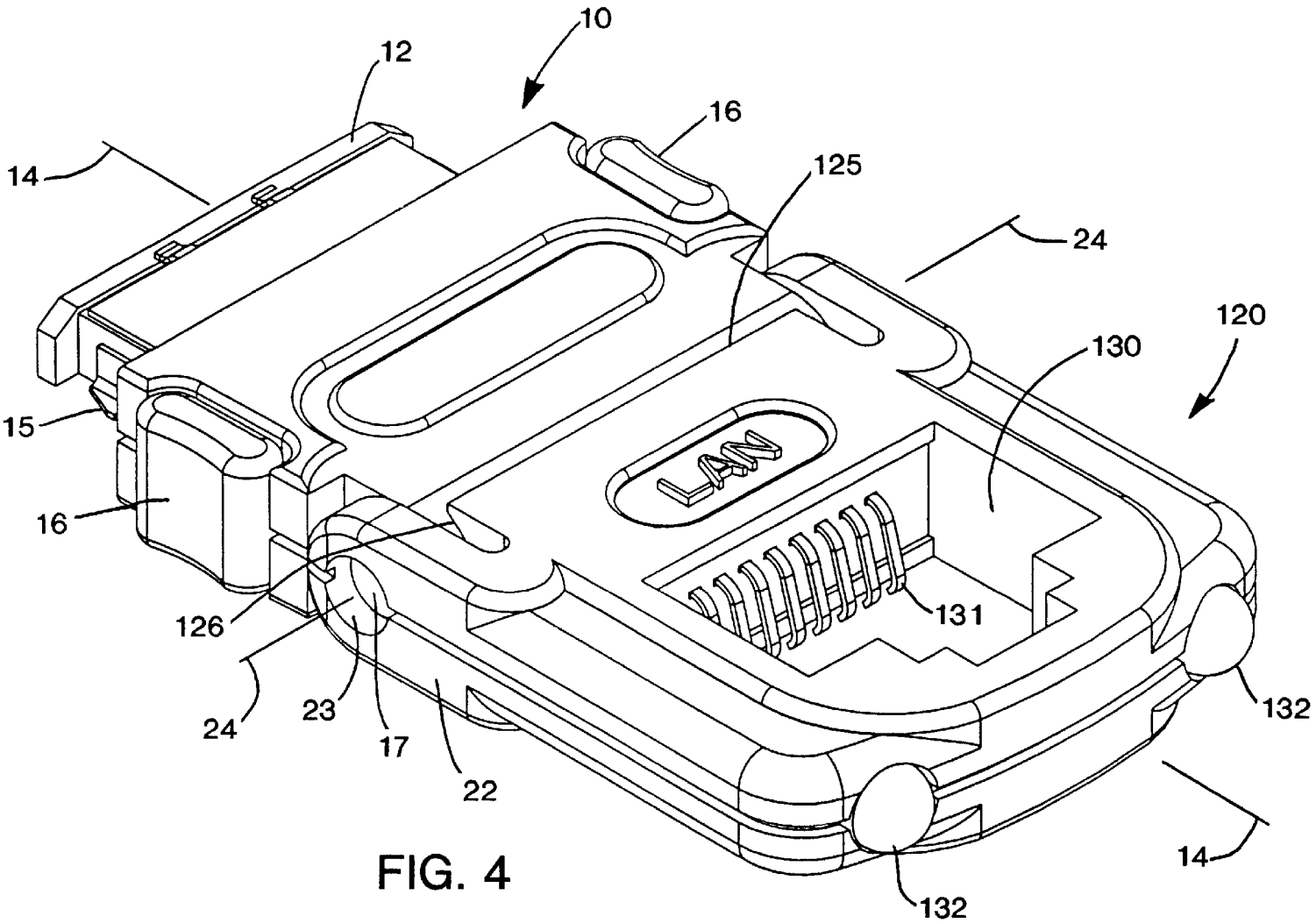
FIG. 4 is rear isometric view of the interconnection device in an alternate embodiment wherein the adapter is a slim vertical loading adapter.
Figure 5:
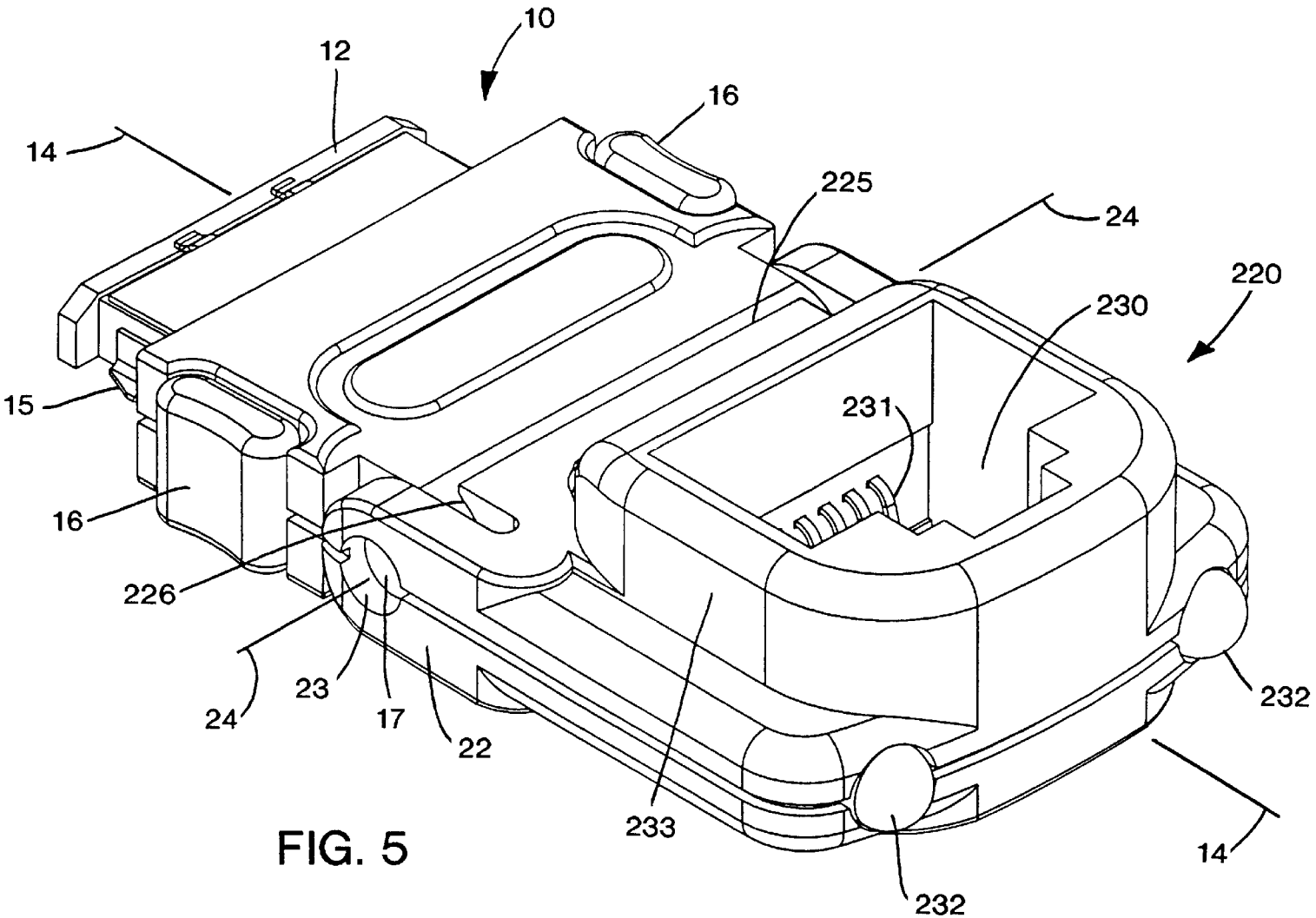
FIG. 5 is a rear isometric view of the interconnection device in an another embodiment wherein the adapter is a flush vertical loading adapter.

Alternate embodiments of the adapter are shown in FIGS. 4 and 5, wherein the same reference numerals are used to indicate the same features as in the previous embodiment. Each of these adapters 120, 220 is termed a vertical loading adapter because each adapter has a receptacle 130, 230 that is open in a direction which is perpendicular to the axis 14 of the I/O connector. Each adapter 120, 220 has contacts 131, 231 that are engageable with contacts of a mating modular plug, and each adapter has visual indicators 132, 232 such as light-emitting diodes (LED's) which illuminate to show that particular circuits are energized.

More particularly, the adapter 120 in FIG. 4 is termed a slim vertical loading adapter which has a height that is approximately the same as the height of the I/O connector 10.

The adapter 220 in FIG. 5 is termed a flush vertical loading adapter because a mating modular plug does not protrude through a bottom of the adapter. This adapter has a raised wall 233 which surrounds the receptacle 230 and is configured to hold the modular plug at an elevated level compared to a modular plug held in the slim vertical loading adapter 120 of FIG. 4.

In order to resist insertion forces of a modular plug in the adapters 120, 220, it may be desired to prevent each adapter from pivoting below the axis 14. Pivoting may be limited by the housing of each adapter having a forward ledge 125, 225 with an undersurface 1261 226 which is configured to engage a rear surface 18 of the I/O connector 10 as required to prevent rotation of the adapter below the axis 14.

The contacts 31, 131, 231 of the adapter and the contacts 13 of the I/O connector are electrically connected by a structure which can accommodate relative angular movement between the adapter and the I/O connector. One such structure is a flexible dielectric film such as polyimide which carries conductive traces having opposite ends that are connected to the adapter contacts and the I/O connector contacts, respectively. Another such structure is a ribbon cable having wire conductors that interconnect the adapter contacts and the I/O connector contacts. An alternate structure includes the adapter contacts having sections that are in sliding engagement with corresponding sections of the I/O connector contacts. The sections that are in sliding engagement will slide in continuous engagement through a full range of pivoting movement of the adapter and I/O connector.

Figure 6:
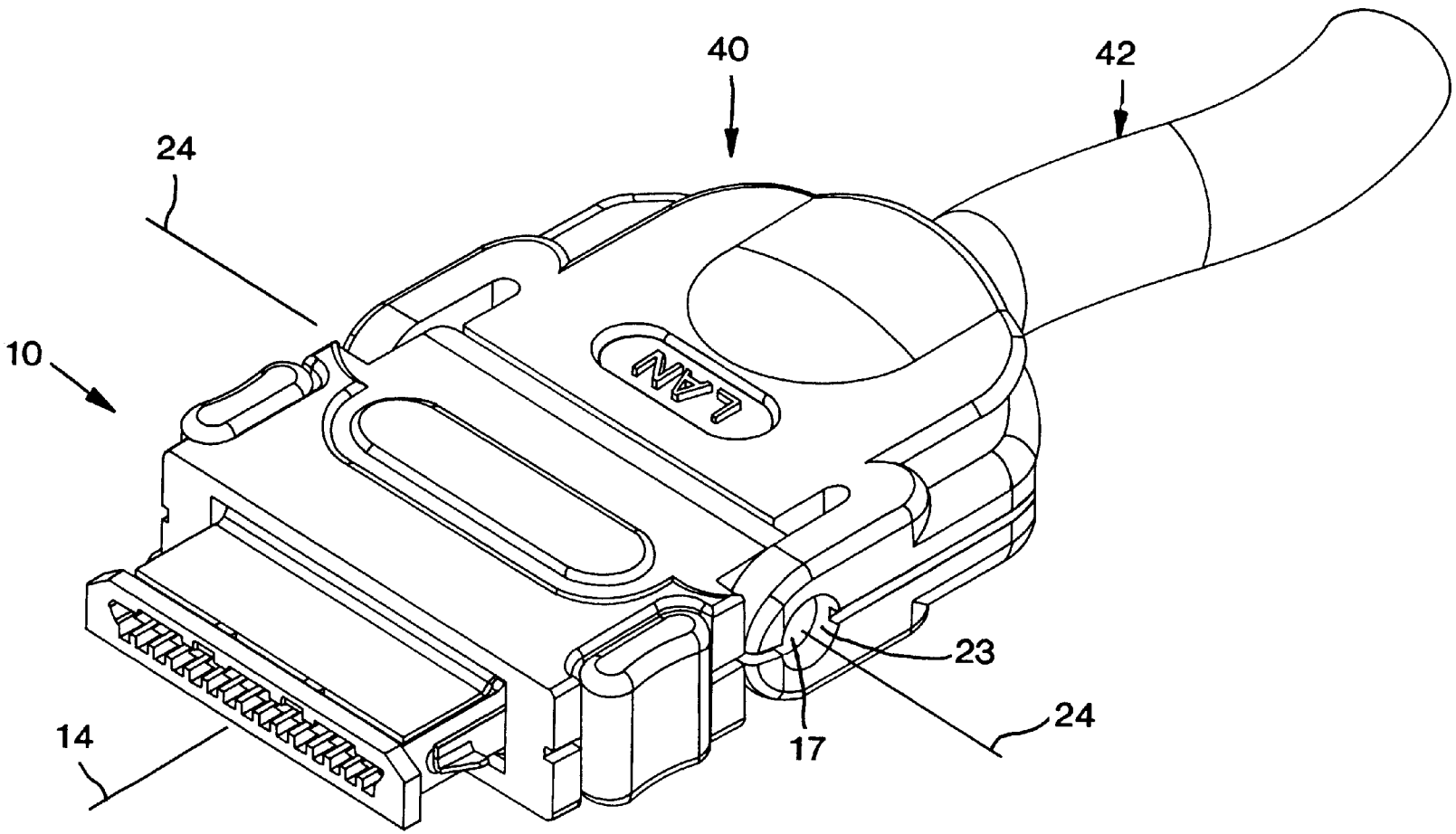
FIG. 6 is a front isometric view of the interconnection device in another embodiment.
Figure 7:
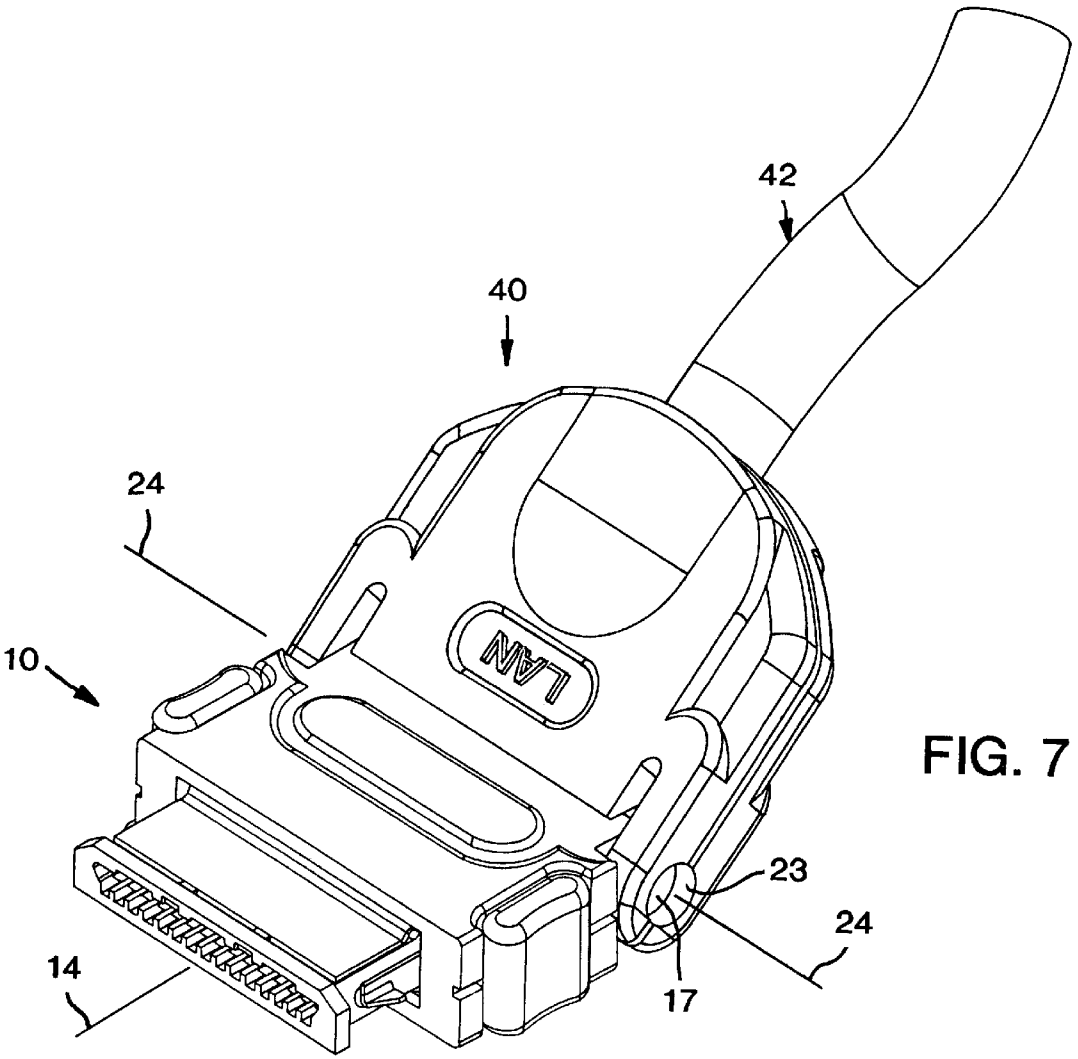
FIG. 7 is a front isometric view of the interconnection device of FIG. 6 showing relative pivoting of first and second connection members.

Another embodiment of the invention is shown in FIGS. 6 and 7. In this embodiment the first connector member 10, or I/O connector, is pivotally coupled to a second connector member 40 which is not an adapter. The second connector member 40 has a second mating end which may be terminated directly to a cable 42 in a known manner such as by insulation displacement contacts. Alternatively, the second mating end may be clamped to the cable 42 so as to provide strain relief, while the cable 42 is electrically connected to the contacts in the first connector member 10 in a known manner. The second connector member 40 includes the arms 22 and the bores 23 of the previous examples. The first and second connector members 10, 40 are relatively pivotable on the axis 24 as in the previous examples. Although this embodiment does not obtain the advantages provided by an adapter having a modular connector interface, this embodiment still has the advantage that likelihood of breakage is reduced because the I/O connector 10 can have a relatively short length in the direction of axis 14.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

I claim:

1. An electrical interconnection device comprising:

a first connector member having a first mating end and a longitudinal axis extending perpendicular to the first mating end, the first connector member having a pair of spaced-apart journals, and a second connector member having a second mating end, the second connector member having a pair of spaced-apart arms with respective bores that receive the pair of spaced-apart journals, wherein the first connector member and the second connector member are pivotally linked to permit relative angular movement therebetween, and the second connector member has a ledge between the pair of spaced-apart arms, the ledge extending toward the first connector member and being engageable with a surface of the first connector member when the second connector member is aligned with the longitudinal axis of the first connector member to prevent the second connector member from pivoting below the longitudinal axis.

2. The electrical interconnection device of claim 1 wherein the second connector member is pivotable on an axis extending perpendicular to the longitudinal axis.

3. The electrical interconnection device of claim 1 wherein the second connector member includes a receptacle that is open in a direction extending parallel to the longitudinal axis.

4. The electrical interconnection device of claim 1 wherein the second connector member includes a receptacle that is open in a direction extending perpendicular to the longitudinal axis.

5. The electrical interconnection device of claim 1 wherein the first connector member is an input/output connector that can mate with a header of a printed circuit card.

6. The electrical interconnection device of claim 5 wherein the second connector member is a modular jack that can mate with an RJ-series modular plug.

* * * * *